US005323614A

United States Patent [19]

Tsukahara et al.

[11] Patent Number: 5,323,614

[45] Date of Patent: Jun. 28, 1994

[54] COMBUSTOR FOR GAS TURBINE

[75] Inventors: Satoshi Tsukahara; Hiroshi Inoue; Noriyuki Hayashi, all of Hitachi; Kazumi Iwai, Mito; Tamio Innami, Tsuchiura; Yoji Ishibashi; Michio Kuroda, both of Hitachi; Yasuhiko Otawara; Hiraku Ikeda, both of Katsuta; Kazuyuki Itoh, Katsuta; Shozo Nakamura, Hitachiota; Hidekazu Fujimura, Mito; Kazuhito Koyama, Hitachi, all of Japan

[73] Assignee: Hitachi, Ltd., Tokyo, Japan

[21] Appl. No.: 3,608

[22] Filed: Jan. 13, 1993

[30] Foreign Application Priority Data

Jan. 13, 1992 [JP] Japan ..... 4-003644

[51] Int. Cl.[5] ..... F02C 01/00

[52] U.S. Cl. ..... 60/737; 60/749; 60/760

[58] Field of Search ..... 60/733, 737, 738, 746, 60/749, 760

[56] References Cited

U.S. PATENT DOCUMENTS

| | | | |
|---|---|---|---|
| 3,817,690 | 6/1974 | Bzyce et al. | 60/749 |
| 3,921,391 | 11/1975 | Hall et al. | 60/749 |
| 4,445,337 | 5/1984 | Davis, Jr. et al. | 60/749 |
| 4,898,001 | 2/1990 | Kuroda et al. | 60/737 |
| 5,054,280 | 10/1991 | Ishibashi | 60/749 X |
| 5,069,029 | 12/1991 | Kuroda et al. | 60/733 X |
| 5,121,597 | 6/1992 | Urushidani et al. | 60/733 X |

FOREIGN PATENT DOCUMENTS 2100060 2/1990 Japan .

*Primary Examiner*—Richard A. Bertsch
*Assistant Examiner*—Michael I. Kocharov
*Attorney, Agent, or Firm*—Antonelli, Terry, Stout & Kraus

[57] ABSTRACT

A premixed combustor for a gas turbine, comprises, a combustion chamber for burning a fuel with an air therein, at least two premixed fuel/air mixture outlets which are juxtaposed with each other, and through each of which a premixed fuel/air mixture flows out into the combustion chamber, and a flow deflection member arranged between the premixed fuel/air mixture outlets, urging the permixed fuel/air mixture from one of the premixed fuel/air mixture outlets to go away from another one of the premixed fuel/air mixture outlets, and terminating in the combustion chamber so that the premixed fuel/air mixture from the one of the premixed fuel/air mixture outlets is permitted to move toward the premixed fuel/air mixture flowing out from the another one of the premixed fuel/air mixture outlets after going away from the another one of the premixed fuel/air mixture outlets.

17 Claims, 6 Drawing Sheets

COMBUSTOR FOR GAS TURBINE

BACKGROUND OF THE INVENTION AND RELATED ART STATEMENT

The present invention relates to a combustor for generating a pressurized gas for driving a gas turbine and more particularly, to a premixed combustor for a gas turbine.

In a prior-art premixed combustor disclosed in Japanese Laid-open Utility Model Application Hei-2-100060, a fuel for diffusion combustion is injected into a combustion chamber by a fuel nozzle at a radially central portion of the combustion chamber, a lean fuel/air mixture is formed in each of the premixing chambers radially surrounding the fuel nozzle to be supplied into the combustion chamber with swirl motion thereof so that the fuel in the lean fuel/air mixture is burned with assistance of the diffusion combustion by the fuel nozzle.

OBJECT AND SUMMARY OF THE INVENTION

An object of the present invention is to provide a premixed combustor for a gas turbine, comprising at least two premixed fuel/air mixture outlets juxtaposed with each other, in which combustor a flame formed by each of the premixed fuel/air mixture outlets is kept stable with a smooth ignition from one of the flames to another one of the flames.

According to the present invention, a premixed combustor for a gas turbine is provided which comprises a combustion chamber in which a fuel is burned with air, with at least two premixed fuel/air mixture outlets which are juxtaposed wit each other, and through each of which a premixed fuel/air mixture flows out into the combustion chamber. A flow detection means is arranged between the premixed fuel/air mixture outlet, urging the premixed fuel/air from one of the premixed fuel/air mixture outlets to go away from another one premixed fuel/air mixture outlets, and terminates in the combustion chamber so that the premixed fuel/air form one of the premixed fuel/air outlets is permitted to move toward the premixed fuel/air flowing out from the another one of the premixed fuel/air outlets after going away from the another one of the premixed fuel-/air mixture outlets.

In the premixed combustor according to the present invention, since the flow deflection means is arranged between the premixed fuel/air mixture outlets, urges the premixed fuel/air mixture from one of the premixed fuel/air mixture outlets to go away from another one of the premixed fuel/air mixture outlets, and terminates in the combustion chamber so that the premixed fuel/air mixture from the one of the premixed fuel/air mixture outlets is permitted to move toward the premixed fuel-/air mixture flowing out from the another one of the premixed fuel/air mixture outlets after going away from the another one of the premixed fuel/air mixture outlets, an eddy flow of the premixed fuel/air mixture directed from the one of the premixed fuel/air mixture outlets toward the another one of the premixed fuel/air mixture outlets is generated at a terminating end of the flow deflection means. Therefore, an ignition from a flame formed by the premixed fuel/air mixture from the one of the premixed fuel/air mixture outlets to a flame formed by the premixed fuel/air mixture from the another one of the premixed fuel/air mixture outlets is achieved easily and securely, so that the flame formed by each of the premixed fuel/air mixture outlets is kept stable with the smooth ignition from one of the flames to another one of the flames.

DETAILED DESCRIPTION OF PREFERRED EMBODIMENTS

Figure 1:
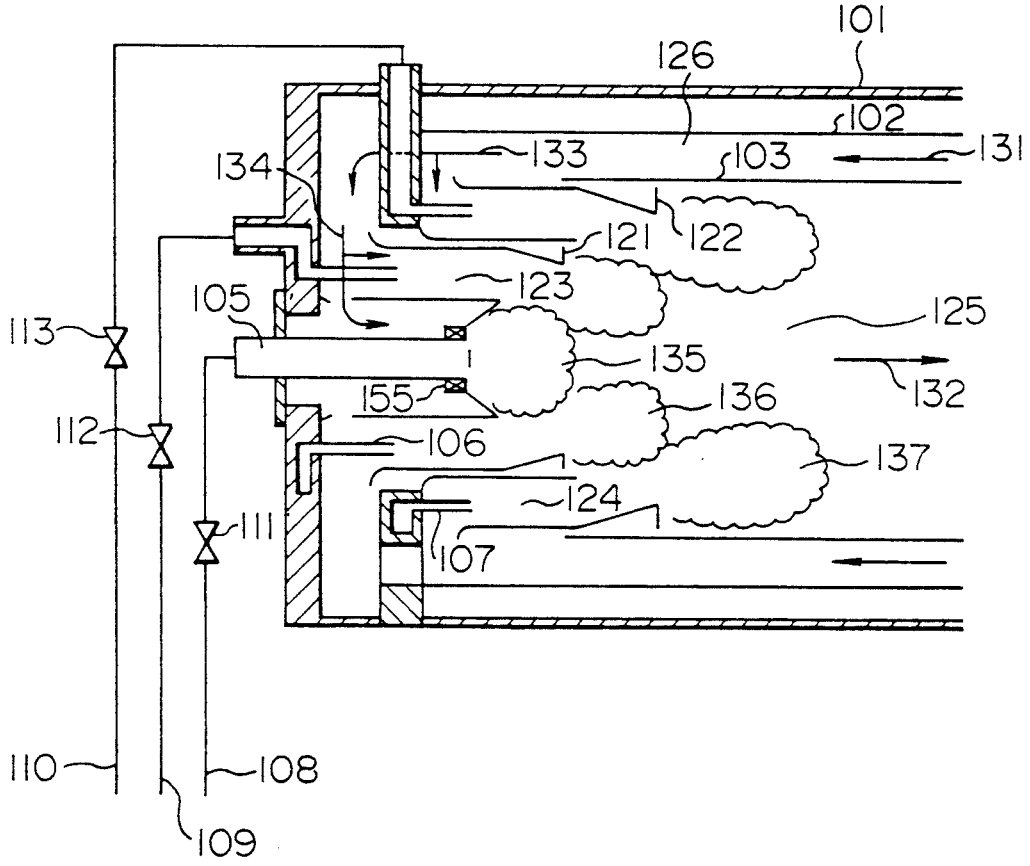
FIG. 1 is a cross-sectional view of a combustor according to the present invention.

In a combustor as shown in FIG. 1, an inner combustion liner 103 forms a combustion chamber 125, a flow sleeve 102 decreases a heat transmission between the combustion chamber 125 and the outside of the combustor to achieve a heat sheltering effect of an outer periphery of the inner combustion liner 103 and a cooling effect of the inner combustion liner 103, an outer combustion liner 101 surrounds the flow sleeve 102 to contain the entire combustor mechanism. A first fuel injection nozzle 105 is arranged at an end of the inner combustion liner 103 on a longitudinal axis thereof, a swirler 155 surrounds the fuel injection nozzle 105 to supply a swirling air flow to an injected fuel from the fuel injection nozzle 105, an annular first premixing chamber 123 into which a fuel is injected by a second fuel nozzle 106 therein is arranged at a radially outer side of the swirler 155, with an annular second premixing chamber 124 into which the fuel is injected by a third fuel nozzle 107 therein being arranged at a radial outside of the first premixing chamber 123. A recess-type first flame holder 121, as the flow deflection mean, is arranged at a radial outside of an outlet of the first premixing chamber 123. The annular flame holder 121 tapers inwardly in the flow direction 132 from the outlet of the annular first premixing chamber 123 as shown in FIG. 1 such that an opening flow arm for the premixed fuel/air mixture at the outlet of the chamber 123 as defined by the flame holder 121 is larger than the opening flow arm for the premixed fuel/air mixture at the downstream end of the inwardly tapered flame holder. This has the effect of throttling the flow of the premixed fuel/air mixture flowing out of the outlet of the chamber 123. second flame holder 122 as the flow deflection means is arranged at a radial outside of an outlet of the second premixing chamber 124. The fuels supplied to the first, second and third fuel injection nozzles 105, 106 and 107 through respective pipes 108, 109 and 110 are adjusted by respective flow rate control valves 111, 112 and 113.

The more radially outer the recess-type second flame holder is, the more axially downstream in a fuel-air flow direction of the combustion chamber 125 the recess-type second flame holder is. That is, the recess-type second flame holder 122 arranged at a radially outer side of the recess-type first flame holder 121 is arranged at a downstream side of the recess-type first flame holder 121 in the flow direction of the combustion chamber 125. An air supplied from a compressor (not shown) proceeds in a direction shown by an arrow 131 in an annular path 126 formed by the inner combustion liner 103 and the flow sleeve 102, is divided subsequently into three ways toward the first and second premixing chambers 123 and 124 and the swirler 155 as shown by arrows 133 and 134, and flows finally into the combustion chamber 125.

When the combustor is in a high-load condition, a diffusion combustion flame 135 is formed at the radial center of the combustion chamber 125 by the fuel injected from the first fuel injection nozzle 105 and the air supplied from the swirler 155, the fuel injected from the second fuel nozzle 106 is mixed with the air in the annular first premixing chamber 123 to form a lean fuel/air mixture and is ignited securely by the diffusion combustion flame 135 to form a premixed combustion flame 136 whose shape is supported stably and appropriately by the recess-type first flame holder 121 arranged at a downstream side of the swirler 155 and the radial outside of the annular first premixing chamber 123, and the fuel injected from the third fuel nozzle 107 is mixed with the air in the annular second premixing chamber 124 to form another lean fuel/air mixture and is securely ignited by the premixed combustion flame 136 supported appropriately by the recess-type first flame holder 121 to form another premixed combustion flame 137 supported stably by the recess-type second flame holder 122 arranged at a downstream side of the recess-type first flame holder 121 and the radial outside of the annular second premixing chamber 124.

When the combustor is in a middle-load condition, the flow rate control valve 113 is closed to stop a fuel supply to the third fuel nozzle 107 so that the premixed combustion flame 137 is extinguished, but a fuel supply to the first fuel and second injection nozzles 105 and 106 is maintained for the diffusion combustion flame 135 and the premixed combustion flame 136.

When the combustor is in a low-load condition, the flow rate control valves 113 and 112 are closed to stop the fuel supply to the second and third fuel nozzles 106 and 107 so that the premixed combustion flames 136 and 137 are extinguished, but the fuel supply to the first fuel injection nozzle 105 is maintained for the diffusion combustion flame 135. In this case, a flow rate of the fuel supply to the first fuel injection nozzle 105 is increased in comparison with the middle-load and high-load conditions, and the fuel from the, first fuel injection nozzle 105 is completely combusted by the air from the swirler 155 and the annular first premixing chamber 123.

Figure 2:
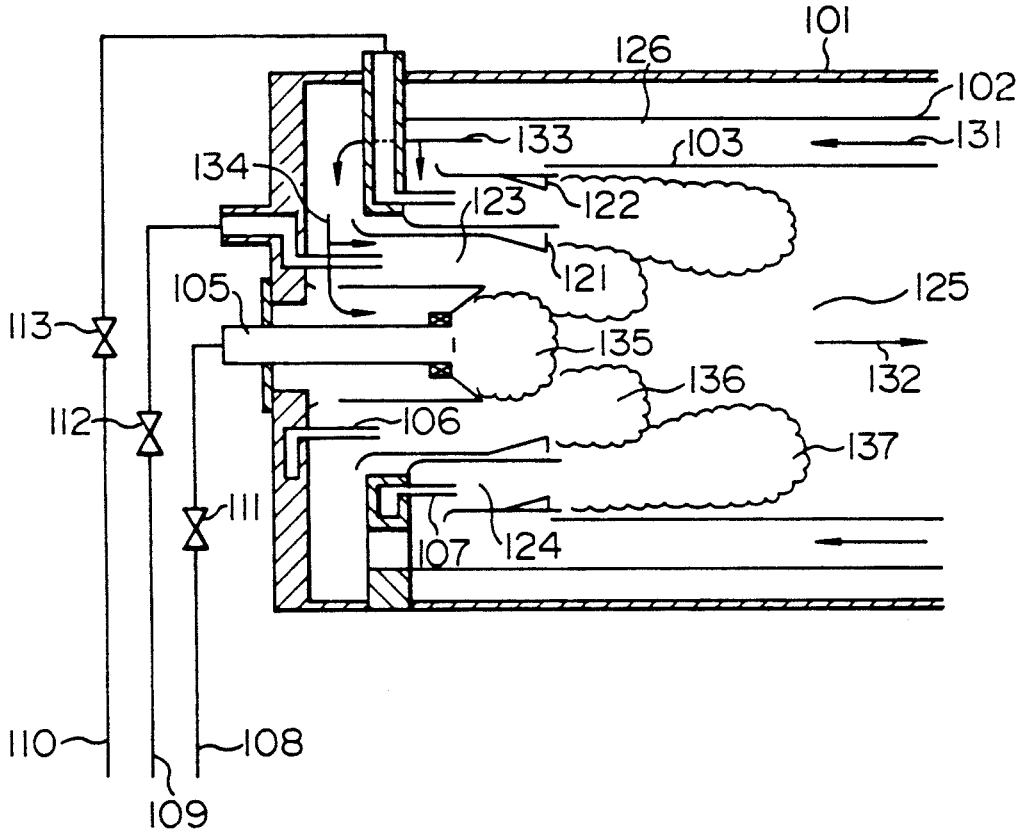
FIG. 2 is a cross-sectional view of another combustor according to the present invention.

As shown in FIG. 2, the recess-type second flame holder 122 and the recess-type first flame holder 121 are arranged at the same position in the flow direction of the combustion chamber 125.

Figure 3:
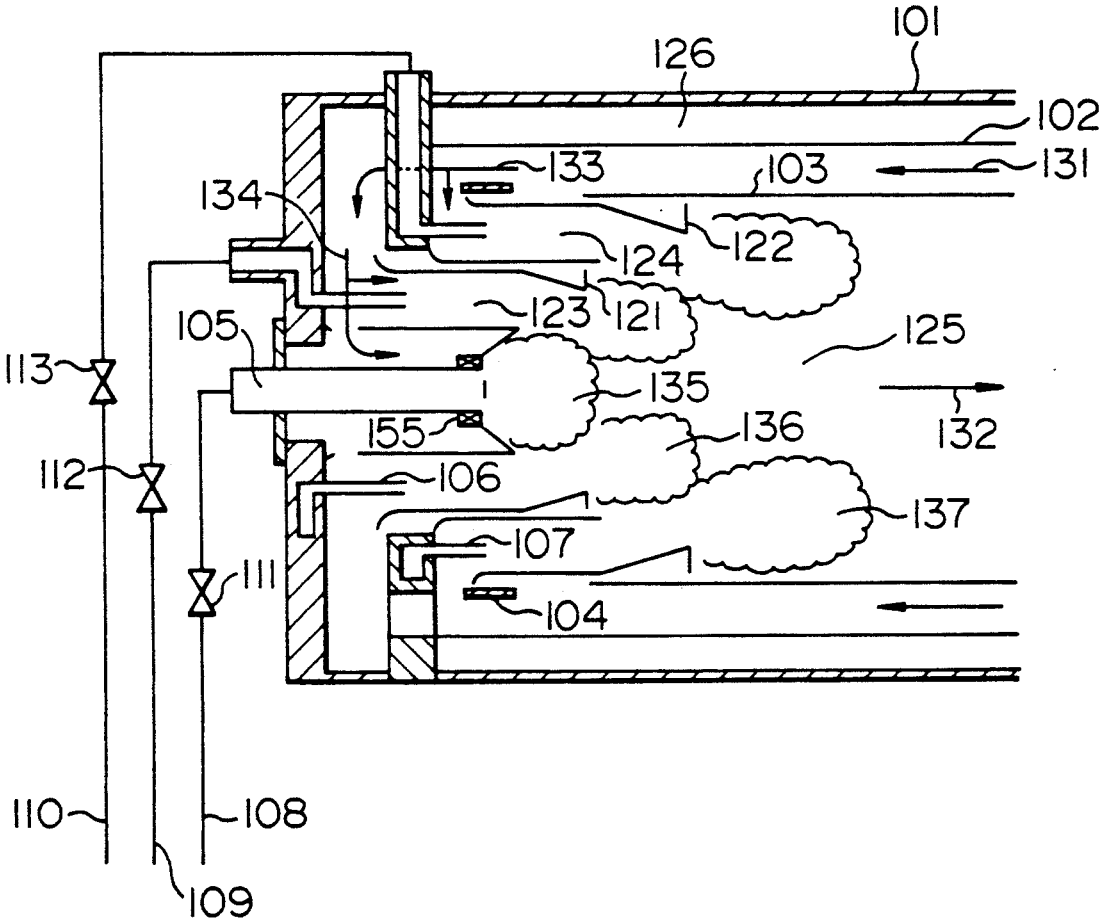
FIG. 3 is a cross-sectional view of a further combustor according to the present invention.

As shown in FIG. 3, an air flow rate control valve 104 may be arranged at an inlet of the annular second premixing chamber 124 to adjust a ratio of an intake air supplied to the annular second premixing chamber 124 to an intake air supplied to the swirler 155 and the annular first premixing chamber 123 and a total amount of the intake air supplied to the annular second premixing chamber 124, the swirler 155 and the annular first premixing chamber 123 so that the flames 135, 136 and 137 in the combustion chamber 125 are kept stable against a variation of the combustor load and an air/fuel mixing is kept appropriate for low NOx concentration.

Figure 4:
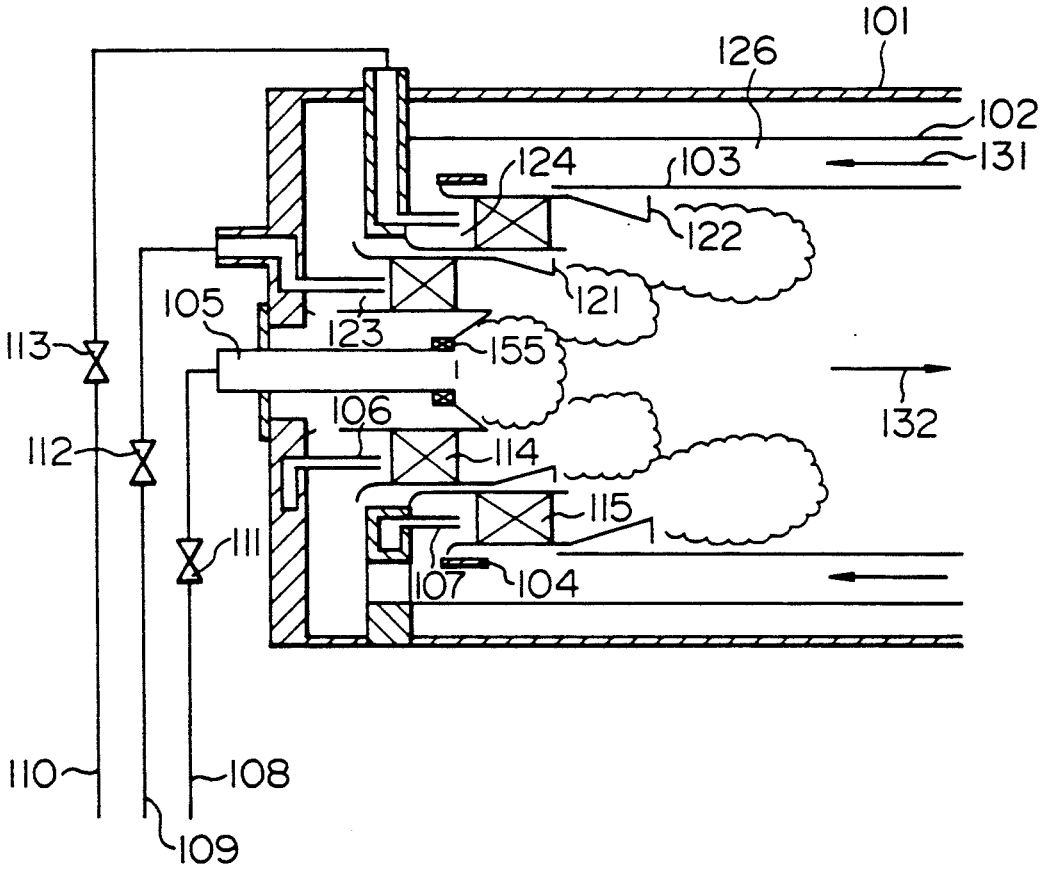
FIG. 4 is a cross-sectional view of yet another combustor according to the present invention.

As shown in FIG. 4, the first and second premixing chambers 123 and 124 have respective swirler vanes 114 and 115 therein for accelerating the premixing between the fuel and the air.

Figure 5:
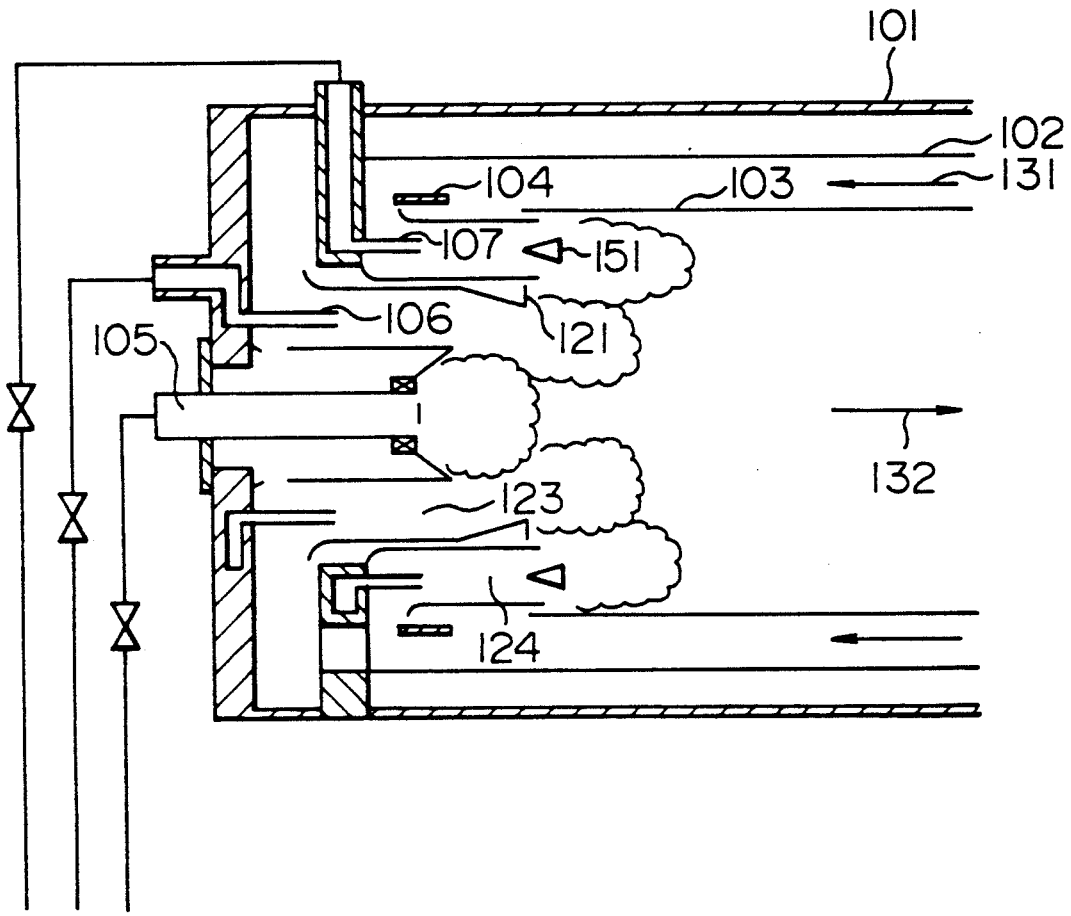
FIG. 5 is a cross-sectional view of another combustor according to the present invention.
Figure 6:
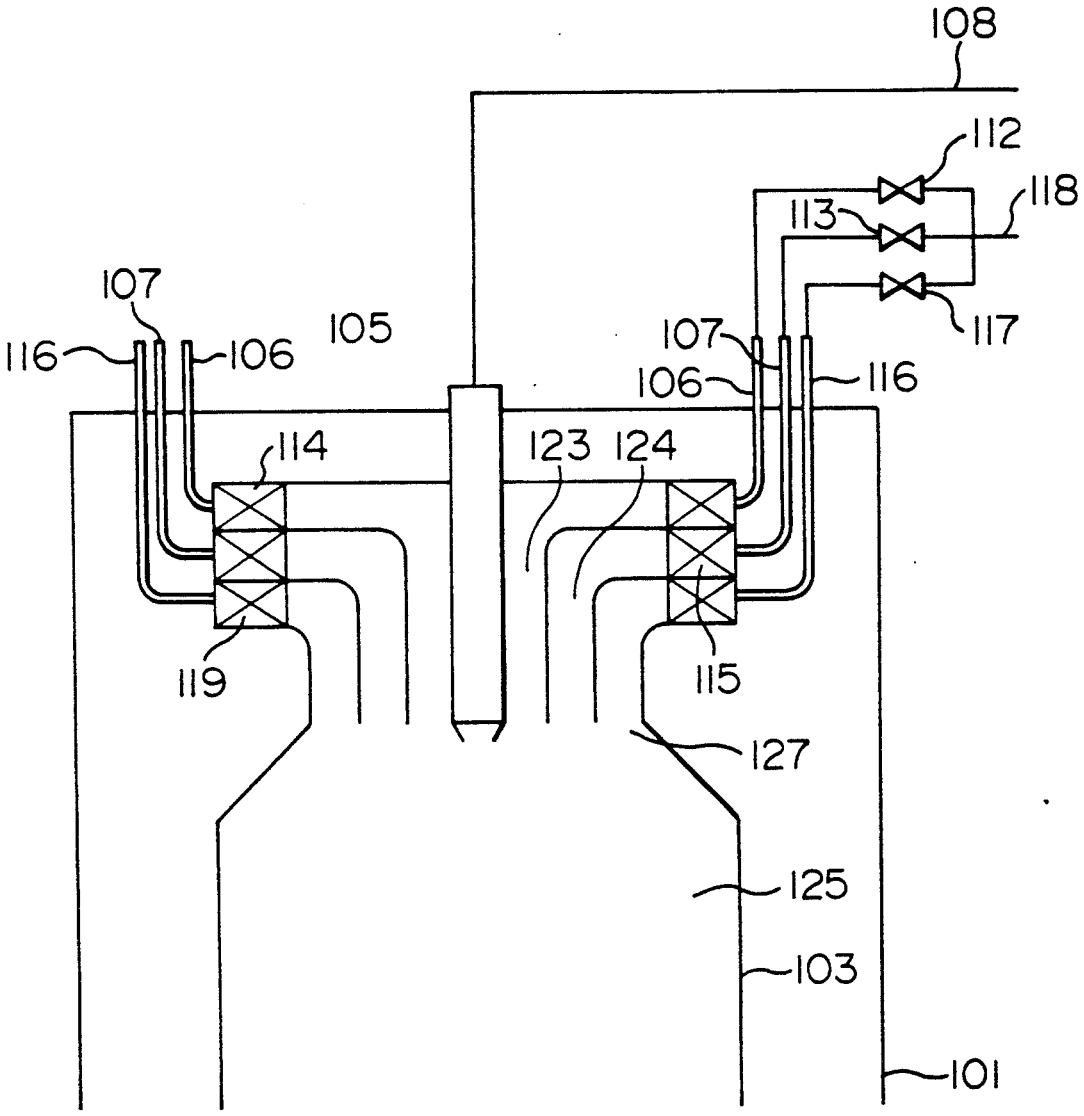
FIG. 6 PRIOR ART
FIG. 6 is a cross-sectional view of a prior-art combustor.

As shown in FIG. 5, the second premixing chamber 124 at a radially outer side of the first premixing chamber may have a bluff body type flame holder 151 instead of the recess-type second flame holder 122, because it is not necessary for the flame formed by the lean fuel/air mixture from the second premixing chamber 124 to ignite another lean fuel/air mixture at a radially outer side thereof.

What is claimed is:

1. A premixed combustor for a gas turbine, comprising;

a combustion chamber for burning a fuel with an air therein, at least two premixed fuel/air mixture outlets which are juxtaposed with each other, and through each of which a premixed fuel/air mixture flows out into the combustion chamber, and a flow deflection means arranged between the premixed fuel/air mixture outlets in the vicinity of a root portion of a flame kept by one of the premixed fuel/air mixture outlets when the premixed fuel/air mixture from another premixed fuel/air mixture outlet is ignited, urging the premixed fuel/air mixture from the one of the premixed fuel/air mixture outlets to go away from the another one of the premixed fuel/air mixture outlets, and terminating in the combustion chamber to permit the premixed fuel/air mixture form the one of the premixed fuel/air mixture outlets to move toward the premixed fuel/air mixture flowing out from the another one of the premixed fuel/air mixture outlets so that an eddy flow of the premixed fuel/air mixture directed from the one of the premixed fuel/air mixture outlets toward the another one thereof is generated at a terminating end of the flow deflection means and when the ignition from the flame formed by the one of the premixed fuel/air mixture outlets to the premixed fuel/air mixture flowing out form the another one thereof is preformed a flame transition therebetween is kept smooth by the eddy flow.

2. A premixed combustor according to claim 1, wherein the flow deflection means extends between the premixed fuel/air mixture outlets to partition the combustion chamber into a part for a flame formed by the premixed fuel/air mixture form the one of the premixed fuel/air mixture outlets and another part for another flame formed by the premixed fuel/air mixture from the another one of the premixed fuel/air mixture outlets.

3. A premixed combustor according to claim 1, wherein an opening flow area for the premixed fuel/air mixture at the one of the premixed fuel/air mixture outlets as defined by said flow deflection means at an upstream end thereof in a flow direction is larger than an opening flow area for the premixed fuel/air mixture at a downstream end of the flow deflection means.

4. A premixed combustor according to claim 1, wherein a flow of the premixed fuel/air mixture flowing out from the one of the premixed fuel/air mixture outlets is throttled by the flow deflection means.

5. A premixed combustor according to claim 1, wherein the one of the premixed fuel/air mixture outlets is separated from the another one of the premixed fuel/air mixture outlets by the flow deflection means.

6. A premixed combustor according to claim 1, wherein the one of the premixed fuel/air mixture outlets is surrounded by the another one of the premixed fuel-/air mixture outlets.

7. A premixed combustor according to claim 1, wherein the one of the premixed fuel/air mixture outlets is surrounded by the another one of the premixed fuel-/air mixture outlets, and is arranged at a radially inner side of the another one of the premixed fuel/air mixture outlets.

8. A premixed combustor according to claim 1, wherein the flow deflection means has an annular shape.

9. A premixed combustor according to claim 1, wherein the flow deflection means is a recess-type flame holder.

10. A premixed combustor according to claim 1, wherein the premixed combustor further comprises a diffusion combustion means for igniting the fuel/air mixture flowing out from the one of the premixed fuel-/air mixture outlets.

11. A premixed combustor according to claim 1, wherein the one of the premixed fuel/air mixture outlets is arranged at an upstream side of the another one of the premixed fuel/air mixture outlets in a premixed fuel/air mixture flow direction.

12. A premixed combustor according to claim 1, wherein the one of the premixed fuel/air mixture outlets has swirl vane means therein.

13. A premixed combustor according to claim 1, wherein the another one of the premixed fuel/air mixture outlets has vortex flow generating means therein to hold a flame formed by the premixed fuel/air mixture flowing out from the another one of the premixed fuel-/air mixture outlets.

14. A premixed combustor according to claim 1, wherein the another one of the premixed fuel/air mixture outlets has a bluff body type flame holder therein to hold a flame formed by the premixed fuel/air mixture flowing out from the another one of the premixed fuel-/air mixture outlets.

15. A premixed combustor according to claim 1, wherein the premixed combustor further comprises a diffusion combustion means which keeps always a diffusion combustion for igniting the fuel/air mixture flowing out from the one of the premixed fuel/air mixture outlets.

16. A premixed combustor according to claim 1, wherein the premixed fuel/air mixture from the one of the premixed fuel/air mixture outlets is firstly ignited, and the premixed fuel/air mixture from the another one of the premixed fuel/air mixture outlets is subsequently ignited when an output of the premixed combustor needs to be increased.

17. A premixed combustor according to claim 1, wherein the one of the premixed fuel/air mixture outlets is arranged at the substantially same position as the another one of the premixed fuel/air mixture outlets in a premixed fuel/air mixture flow direction.

* * * * *